United States Patent [19]

Baker et al.

[11] Patent Number: 4,604,610

[45] Date of Patent: Aug. 5, 1986

[54] SWIMMING POOL ALARM

[75] Inventors: Robert W. Baker; Dean Donely, both of Scarborough; Vlado Odorcic, Willowdale, all of Canada

[73] Assignee: Nathan I. Hennick, Toronto, Canada

[21] Appl. No.: 700,499

[22] Filed: Feb. 11, 1985

[51] Int. Cl.[4] ..... G08B 13/00

[52] U.S. Cl. ..... 340/566; 340/624; 340/573

[58] Field of Search ..... 340/566, 565, 573, 623, 340/624; 73/DIG. 5; 200/82 R, 190

[56] References Cited

U.S. PATENT DOCUMENTS 3,810,146 5/1974 Lieb ..... 340/573 X 4,510,487 4/1985 Wolfe ..... 340/566

4,533,907 8/1985 Thatcher ..... 340/565

*Primary Examiner*—Glen R. Swann, III

*Assistant Examiner*—Jeffery A. Hofsass

*Attorney, Agent, or Firm*—Ridout & Maybee

[57] ABSTRACT

A swimming pool alarm has a hydrophone located well below the surface of the pool and spaced from its walls, the hydrophone being associated with a captive sensor element which responds to vertical wave motion of the pool water at levels well below the surface by impacting the hydrophone transducer. The hydrophone is associated with an amplifier and peak detector, elevation of the detector output above a set threshold triggering an alarm either responsive to high level audio signals reaching the hydrophone, or to deep water disturbance within the pool.

7 Claims, 3 Drawing Figures

SWIMMING POOL ALARM

FIELD OF THE INVENTION

This invention relates to swimming pool alarms intended to provide warning should a person or domestic pet fall into an unattended swimming pool, or in the event of use of the pool by unauthorized persons.

BACKGROUND OF THE INVENTION AND PRIOR ART STATEMENT

A very large number of different forms of swimming pool alarm have been proposed, and a large number of different alarms have actually been marketed. However, to the best of applicant's knowledge, none of these devices has been entirely satisfactory, the major problem being to provide sufficient sensitivity to trigger the alarm whenever it should be triggered without incurring a large number of false alarms. Whilst from the point of view of demonstration, a high sensitivity to water disturbance is impressive, in practical use it is an unmitigated nuisance unless accompanied by some ability to discriminate between disturbances which require investigation, and those which do not, such as wind disturbances, low flying aircraft, and the impact of twigs and other small objects.

Most of the alarms proposed to date have fallen into three main classes, according to the nature of the alarm transducer. In a first class of alarm, exemplified by the alarms of U.S. Pat. Nos. 3,778,803, 3,475,746, 3,683,353 and 3,723,398, the transducer is essentially wave responsive, triggering the alarm in response to surface disturbances of the pool of greater than a predetermined magnitude. There are various ways in which such devices may be falsely triggered, but their principal failing is that ripples quite large enough to trigger the alarm can readily be generated by wind. A second class of alarm discussed at column 1, lines 22–36 and 52–60 of U.S. Pat. No. 3,778,863 and exemplified by U.S. Pat. No. 2,882,915 (McCoy) is triggered by some form of hydrophone. The problem with this type of alarm is that it can be triggered by loud noises external to the pool, such as low flying aircraft.

A third class of alarm has a pressure sensitive transducer exemplified by the alarm of U.S. Pat. No. 2,935,582 which responds to pressure effects in the water. However, this type of alarm again is too readily set off by minor water disturbances if it is to be sensitive enough to trigger for example in response to a small child or domestic pet struggling in the water.

In order to reduce susceptability to false alarms, it has been proposed to integrate the transducer output, as in U.S. Pat. No. 3,969,712 to Butman et al and U.S. Pat. No. 2,942,247 to Lienau et al.

In a commonly assigned copending application of Edward N. Woolley, Ser. No. 579,576, there is disclosed a swimming pool alarm comprising a triggerable alarm device, a transducer head incorporating a high Q resonator element having an ultrasonic resonant frequency and submersible in a swimming pool, and means sensitive to the amplitude of the resonance of the element and operative to trigger the alarm device. Preferably, the resonator is housed in a tuned cavity and a movable freely agitatable element is housed with the cavity to build up the amplitude of resonance in response to sustained water disturbances. This device as described requires a relatively expensive piezoelectric resonator element, and in its preferred form the effectiveness of the agitation element and cavity are difficult to control.

SUMMARY OF THE INVENTION

We have now found that by using a transducer unit operating upon somewhat different principles, we can obtain a more predictable performance in structure which should be cheaper to manufacture, whilst still obtaining a substantial degree of discrimination between real and false alarm conditions. We have found that the impact of a body of substantial size on a pool, and/or subsequent movement of that body within the pool, results in the propagation of wave motions through the pool water at substantial depths beneath the surface, these wave motions having a significant vertical component. Such motions are not generated by external noise or surface disturbances such as those caused by wind or twigs.

According to the invention a swimming pool alarm comprises a triggerable alarm device, a transducer head incorporating an audio frequency transducer element, means to support said transducer head for submersion in and acoustically coupled to the water of a swimming pool, at a location clear of any wall of the latter and at a depth of at least 30 cm, and a sensor element hydraulically coupled to the water of the pool and mechanically coupled for transmission of impulses to the transducer element through lost motion means permitting limited vertical movement of the sensor element relative to the transducer element, the sensor element having a mean density differing only slightly from that of the pool water, and amplifier means coupling said transducer head to said triggerable alarm device whereby to trigger the latter only in the event of the transducer head output reaching a predetermined level, whether in response to sounds acoustically coupled to said transducer element, or to wave motions hydraulically coupled to said sensor element causing transmission of impacts to said transducer element.

Further features of the invention will become apparent from the following description with reference to the accompanying drawings.

SHORT DESCRIPTION OF THE DRAWINGS

FIG. 1 is a vertical section through a transducer head of an alarm in accordance with the invention; and FIGS. 2 and 3 are electronic schematic diagrams of the transducer head and of an associated alarm unit respectively.

DESCRIPTION OF THE PREFERRED EMBODIMENT

Figure 1:
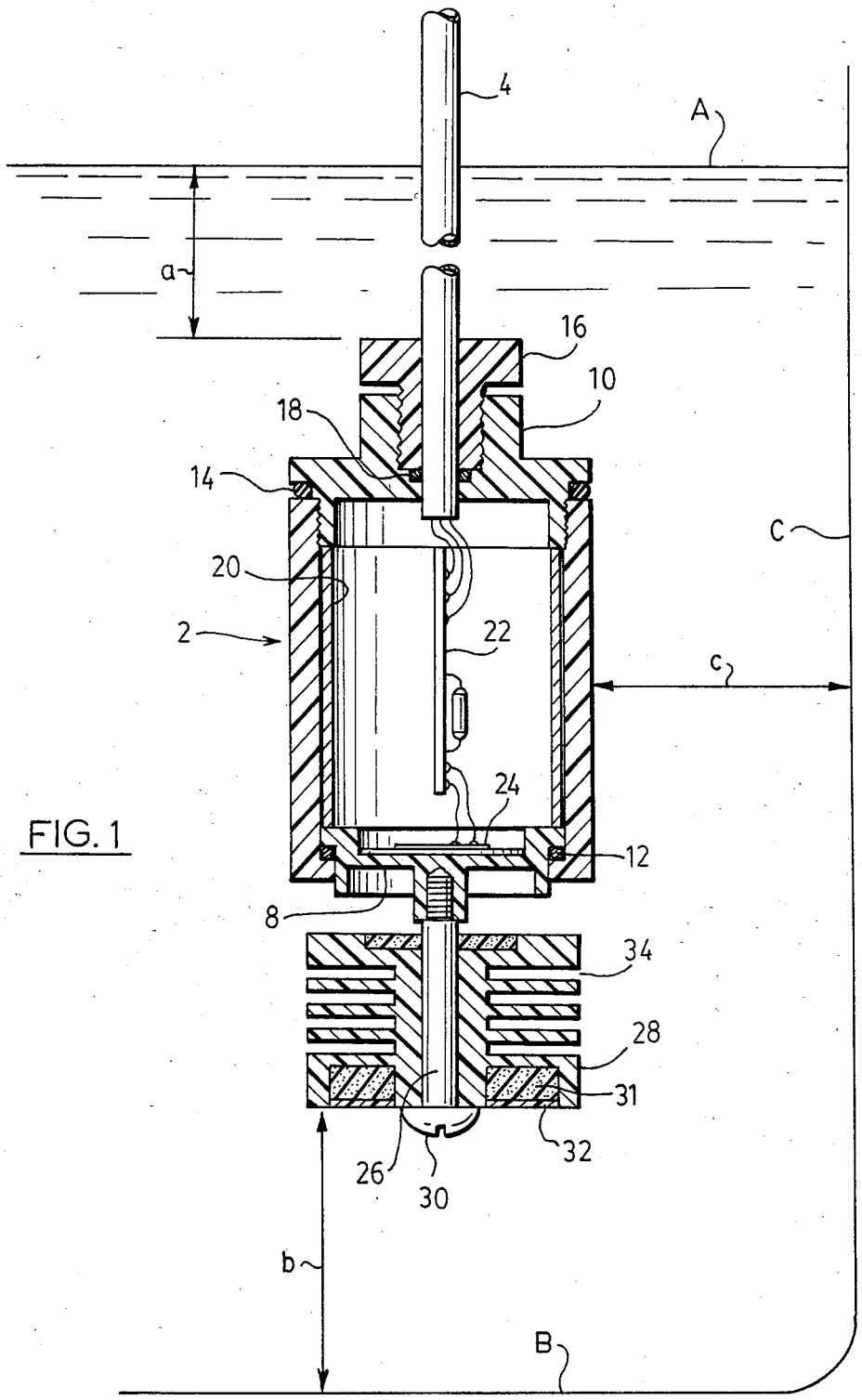

Referring to the drawings, the transducer unit 2 shown in FIG. 1 is, when is use, suspended in the water of a swimming pool to be monitored, at a depth and location selected according to principles set out further below, by means of a multi-conductor shielded cable 4. The transducer unit has a cylindrical body 6, a transducer support member 8 closing the lower end of the cylinder, and a cap 10 screwed into the top of the cylinder, the member 8 and cap being sealed to the body by O-rings 12 and 14 captive between flanges formed on the various parts. The cable 4 passes through the cap 10 and is locked and sealed to it by a threaded nipple 16 and an O-ring 18. Within the body, a slotted cylinder 20 supports a printed circuit board 22, and a flexural mode transducer element 24 is bonded to the upper surface of the member 8. The circuit board 22 carries components of a preamplifier described further below with reference to FIG. 2, and is connected respectively to the element 24 and conductors of the cable 4.

A socket formed in the bottom of member 8 receives a screw 26 which provides a mechanical linkage between the transducer element and a sensor element 28 shown resting on a head 30 of the screw. The length of the screw is such as to permit a small amount of lost motion of the element relative to the screw. The element 28, which like the other structural components so far described may be moulded from synthetic resin, is arranged to have a mean density very slightly differing from (in this case exceeding) that of the water in which the unit is to be submerged. This may be achieved by filling a recess in the top or bottom of the element with plastic foam 31 to reduce the mean density, the foam being enclosed by a cap 32. It will be appreciated that the density required will be lower if the pool is filled with salt water.

The element 28 is formed with a plurality of deep circumferential slots 34 to improve its hydraulic coupling to the surrounding water, so that vertical movement of the water will be transmitted to the element and cause it to move up and down relative to the screw 26 and alternately impact the socket on the member 8 and the screw head 30, which impacts flexural shock to the transducer element 24.

Figure 2:
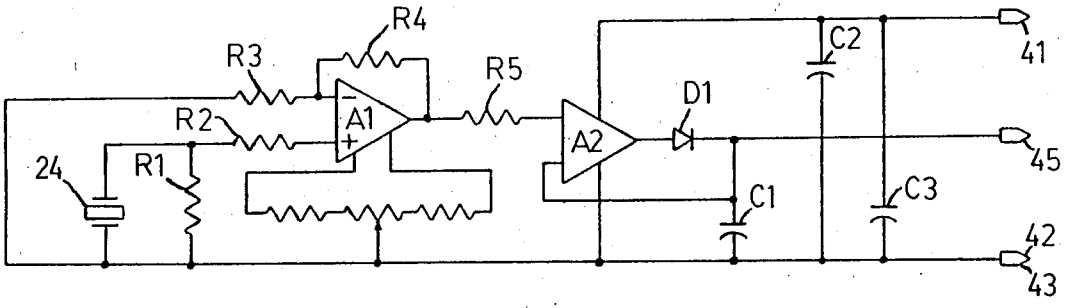

Referring to FIG. 2, the element 24, which can be a readily available piezoelectric audio transducer element, is fairly heavily damped by a resistor R1 to broaden its frequency response, typically so that it will provide useful output over a frequency range of about 1000 Hz to 15 kHz, and is applied through resistor R2 to the non-inverting input of an operational amplifier A1 38, the gain of which is determined by the network formed by resistors R3 and R4. The output of this amplifier is fed by resistor R5 to an amplitude detector formed by a second operational amplifier A2 in conjunction with a diode D1 and a reservoir capacitance of which part is formed by capacitor C1. Both amplifiers A1 and A2 may conveniently be implemented by integrated circuits of type CA3140 or equivalent components. The cable 4 includes a supply conductor 41, a supply ground conductor 43, a signal output conductor 45 and a signal ground conductor 42 connected to the shield of the cable. Ceramic and electrolytic capacitors C2 and C3 decouple one end of the supply line 45, which is further decoupled at its other end by capacitors C6 and C7 (see FIG. 3).

Figure 3:
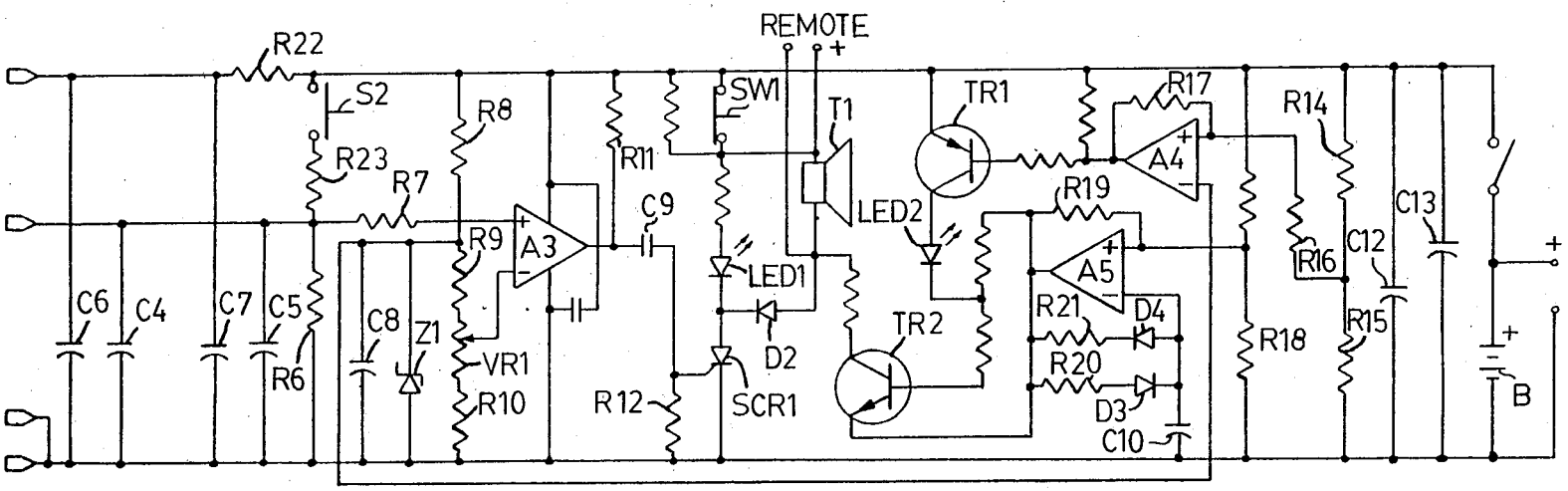

Referring now to FIG. 3, the balance of the load capacitance of the detector is provided at the other end of conductor 45 by capacitors C4 and C5. Resistor R6 forms a detector load, and the potential developed across it is applied through resistor R7 to the non-inverting input of a comparator formed by an operational amplifier A3, the inverting input of which receives an adjustable reference potential from the network formed by a sensitivity control potentiometer VR1, resistors R8, R9 and R10, voltage reference Z1 and capacitor C8. When the input to the comparator exceeds the reference potential, the comparator output potential developed across resistor R11 swings positive, and a pulse developed by the differentiating network formed by capacitor C9 and resistor R12 is applied to the gate terminal of a thyristor SCR1 to fire the latter and permit current to pass through a normally closed switch SW1, both to a visual alarm indicator formed by a light emitting diode LED1 in series with a resistor R13 and a piezoelectric transducer T1, forming an alarm trigger, in series with a diode D2. Opening the switch SW1 interrupts the current through thyristor SCR1 and causes it to turn off both the audible and visual alarms.

A further comparator formed by operational amplifier A4 and resistors R16 and R17 compares the potential developed by a rechargeable battery B across a potentiometer formed by resistors R14 and R15 with that developed across the voltage reference Z1. If the battery potential falls below a predetermined level, a transistor TR1 is turned on and a light emitting diode LED2 connected between the transistor collector and the output of a low frequency pulse generator formed by operational amplifier A5, resistors R18, R19, R20 and R21, capacitor C10 and diodes D3 and D4 is caused to flash. A further transistor TR2 is also pulsed on, causing the transducer T1 to "beep", although the presence of diode D2 prevents turn-on of LED1, thus avoiding confusion. The battery potential is coupled by capacitors C11, C12 and C13, and is transmitted to line 45 through resistor R22.

A test facility is provided by switch S2 and series resistor R23, which enables the alarm to be activated, and a remote alarm may be connected to additional terminals in parallel with transducer T1.

In use, the transducer unit 2 is submerged in a pool to be monitored. The depth of submersion a must be sufficient to avoid the unit being affected by surface disturbances, and should usually be at least 30 cm and preferably about 50 cm below the surface A. It should also preferably be a distance b of at least 50 cm above the bottom B of the pool, and a sufficient distance c from the pool wall C to avoid standing wave effects in the pool water: normally about 10 cm should be sufficient. Although the above dimensions are given as a guide, it should be understood that the objective is to ensure that the transducer is sufficiently spaced from the pool structure and the water surface to avoid on the one hand suppression by interaction with the pool structure of vertical wave motion in the water which it is desired to detect, and on the other hand reaction to surface disturbances which in the absence of vertical wave motion at a lower level do not indicate a true alarm condition. It should also be placed well clear of sources of water disturbance such as skimmers and water inlets. For the purposes of convenience of illustration, the distances a, b and c in FIG. 2 are shown on a much smaller scale than the transducer head itself.

A body of significant size falling into a pool generates an initial shock wave which will be picked up by the transducer element 24 by transmission through the member 8. Since the element 24 is quite heavily damped, it will act as a simple hydrophone in response to such a shock wave, and if the amplitude of the wave when detected by the detector formed by A2 and D1 exceeds a predetermined level set by the sensitivity control VR1 then the thyristor SCR1 will be triggered setting off the alarm transducer T1.

Experiment has shown that the initial shock wave is followed by the relatively slow propagation of a wave motion through the water of the pool, this wave motion having a significant and sustained vertical component. When this wave motion reaches the sensor unit, which may take up to 5–15 seconds depending on the size of the pool, the vertical component of the water movement is transmitted to the sensor 28 by reason of its hydraulic coupling to the water which is enhanced by the slots 34 and flat or recessed bottom of the unit, and the sensor 28 thus moves up and down as described above, the lost motion of the element and its mean specific gravity relative to the water being such that the shocks imparted to the transducer element 24 cause a sufficient output from the detector to trigger the alarm in response to significant wave motion in the deeper levels of the pool.

The apparatus can thus be set up so that sound at a sufficient level transmitted through the water of the pool will trigger the alarm, whilst at the same time, deep level water disturbances will also trigger the alarm. Thus the sensitivity control can be set to exclude false alarms due to ambient noise and minor impacts on the water surface from leaves or twigs, whilst responding in its hydrophone mode to heavier water impacts or high level ground impacts on the pool surround (which may provide warning of trespassers). The wave responsive mode of operation will provide response to water displacement below surface level, thus providing response to a body moving in the pool even if the initial impact on entry of the body has been insufficient to trigger the alarm.

We claim:

1. A swimming pool alarm apparatus comprising a triggerable alarm device, a transducer head incorporating an audio frequency transducer element, means to support said transducer head for submersion in and acoustically coupled to the water of a swimming pool, at a location clear of any wall of the latter and at a epth of at least 30 cm, and a sensor element hydraulically coupled to the water of the pool and mechanically couple for transmission of impulses to the transducer element through lost motion means permitting limited vertical movement of the sensor element relative to the transducer element, the sensor element having a mean density differing only slightly from that of the pool water, and amplifier means coupling said transducer head to said triggerable alarm device whereby to trigger the latter only in the event of the transducer head output reaching a predetermined level, whether in response to sounds acoustically coupled to said transducer element, or to wave motions hydraulically coupled to said sensor element and causing transmission of impacts to said transducer element.

2. An alarm apparatus according to claim 1, wherein the transducer element is mounted on a bottom wall of the transducer head, and the sensor element is supported beneath said bottom wall by said least motion means.

3. An alarm apparatus according to claim 2, wherein the lost motion means is a column delending from said bottom wall through an opening in the sensor element, and having abutments restricting vertical motion of the sensor element.

4. An alarm apparatus according to claim 3, wherein the sensor element is generally cylindrical, and has peripheral slots to increase its hydraulic coupling to the surrounding water.

5. An alarm apparatus according to claim 1, wherein the sensor element is formed primarily from one material, and defines a recess which is filled with a different material to adjust its specific gravity.

6. An alarm apparatus according to claim 1, wherein said amplifier means are at least in part located in said transducer head.

7. An alarm apparatus according to claim 1, wherein said amplifier means comprises a preamplifier receiving an audio frequency signal from said transducer, and a peak detector following the amplitude of the output signal of the preamplifier, and the triggerable alarm device comprises a comparator comparing the output of the detector with an adjustable threshold, and an alarm triggered by a change of state of the comparator.

* * * * *